US005667468A

United States Patent [19]

Bandura

[11] Patent Number: 5,667,468

[45] Date of Patent: Sep. 16, 1997

[54] SCREW ADJUSTABLE WICKET PINS

[75] Inventor: Vitaly Bandura, Danvers, Mass.

[73] Assignee: Battenfeld Gloucester Engineering Co., Inc., Gloucester, Mass.

[21] Appl. No.: 337,070

[22] Filed: Nov. 10, 1994

[51] Int. Cl.[6] ..... B31B 49/04

[52] U.S. Cl. ..... 493/475; 493/473; 493/204; 198/692

[58] Field of Search ..... 493/194, 195, 493/196, 197, 204, 473, 475; 198/692, 693, 472; 74/424.8; 269/242

[56] References Cited

U.S. PATENT DOCUMENTS

| | | | |
|---|---|---|---|
| 2,240,688 | 5/1941 | Conner | 269/242 |
| 3,555,977 | 1/1971 | Saumsiegle | 198/692 |
| 3,844,177 | 10/1974 | Bourassa | 74/424.8 B |
| 4,252,233 | 2/1981 | Joice | 198/692 |
| 4,371,365 | 2/1983 | Shingō | 493/25 |
| 5,074,735 | 12/1991 | Stock | 198/692 |

*Primary Examiner*—Joseph J. Hail, III
*Assistant Examiner*—Darren Ark
*Attorney, Agent, or Firm*—D. J. Shade

[57] ABSTRACT

A sideweld bag making machine utilizing a rotary transfer device and wicket conveyer is equipped with screw adjustable transfer wicket pins. The bases for the transfer wicket pins are mounted on a threaded rod having two sections of thread, each of opposite hand. Rotation of this threaded rod affects the separation of the wicket pins. Adjustment of vertical position is accomplished by means of two jacking screws or a screw adjustment in conjunction with a motion limiting rail element.

12 Claims, 7 Drawing Sheets

FIG. 6A
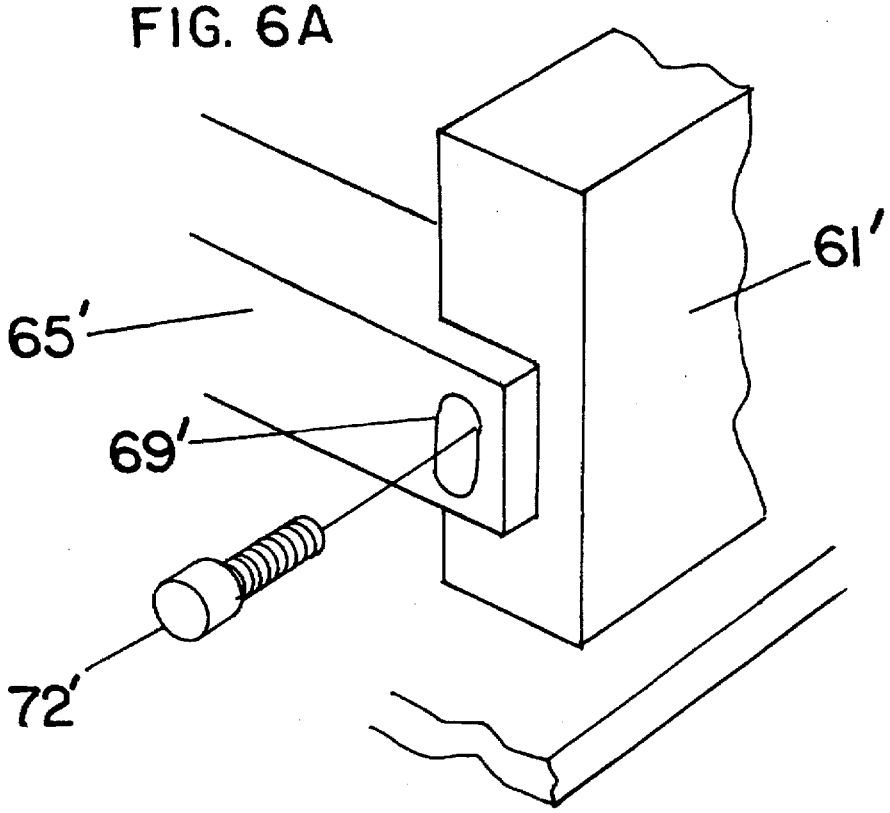
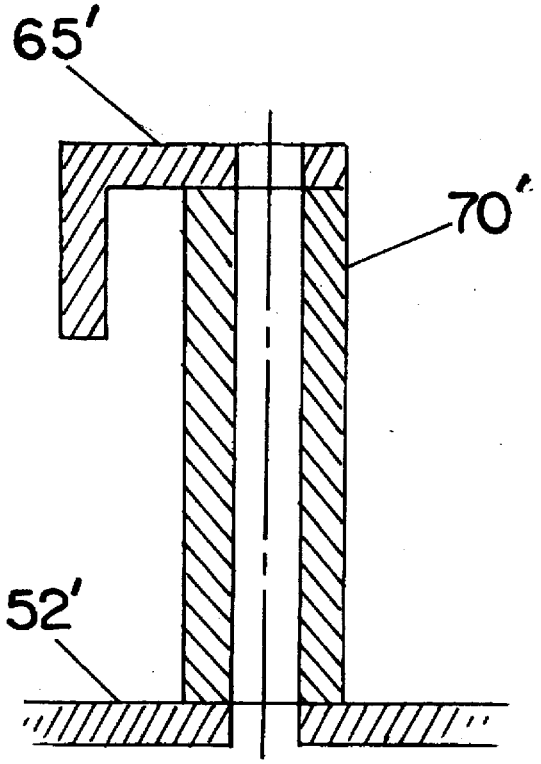
FIG. 6B

SCREW ADJUSTABLE WICKET PINS

BACKGROUND OF THE INVENTION

1. Field of the Invention

This invention pertains to an improved mechanism for positioning transfer wicket pins in a bag machine having a rotary bag transfer mechanism and a wicketing conveyer.

2. Prior Art

The importance of accurately aligning and positioning transfer wicket pins on wicketing conveyers used in conjunction with sideweld bag making machines and equipped with rotary transfer devices has long been recognized. Both the separation of the pins and their largely vertical orientation is essential to properly position the pins to receive the bags from the rotary transfer device. One method of positioning the pins, i.e. clamping them to a cylindrical rod running parallel to the base of the wicket plate, is described in a co-pending application assigned to the assignee of the current application and bears Ser. No. 08/337071. Another method of aligning pins is shown in U.S. Pat. No. 4, 252,233 where the pins are moved along the edge of the wicket plate, and clamped in position by a bar running over the top surfaces of a base section of a transfer wicket pin.

SUMMARY OF THE INVENTION

It is therefore an object of the present invention to provide a new and useful means of readily adjusting wicket pin position, both for separation of the pins and for proper angular alignment. It is another object of the present invention to provide a new means for properly aligning transfer wicket pins, both as to their separation and as to their angular orientation that can be retrofitted to machines already existing in the field.

In accordance with the present invention there is provided a transfer wicket pin adjustment and mounting assembly for use on wicket conveyers comprising:

a) a wicket base plate, b) a threaded rod having a first threaded portion and a second threaded portion, said first threaded section and said second threaded section having threads of opposite hand, c) Mounting blocks mounting both ends of said threaded rod to said wicket base plate, d) A first wicket pin base mounted on said first threaded portion, e) A second wicket pin base mounted on said second threaded portion, f) Both said first transfer wicket pin base and said second transfer wicket pin base having an angular orientation mechanism consisting of a screw adjustment extending from said transfer wicket pin base to said wicket plate.

DESCRIPTION OF THE PREFERRED EMBODIMENT

Figure 1:
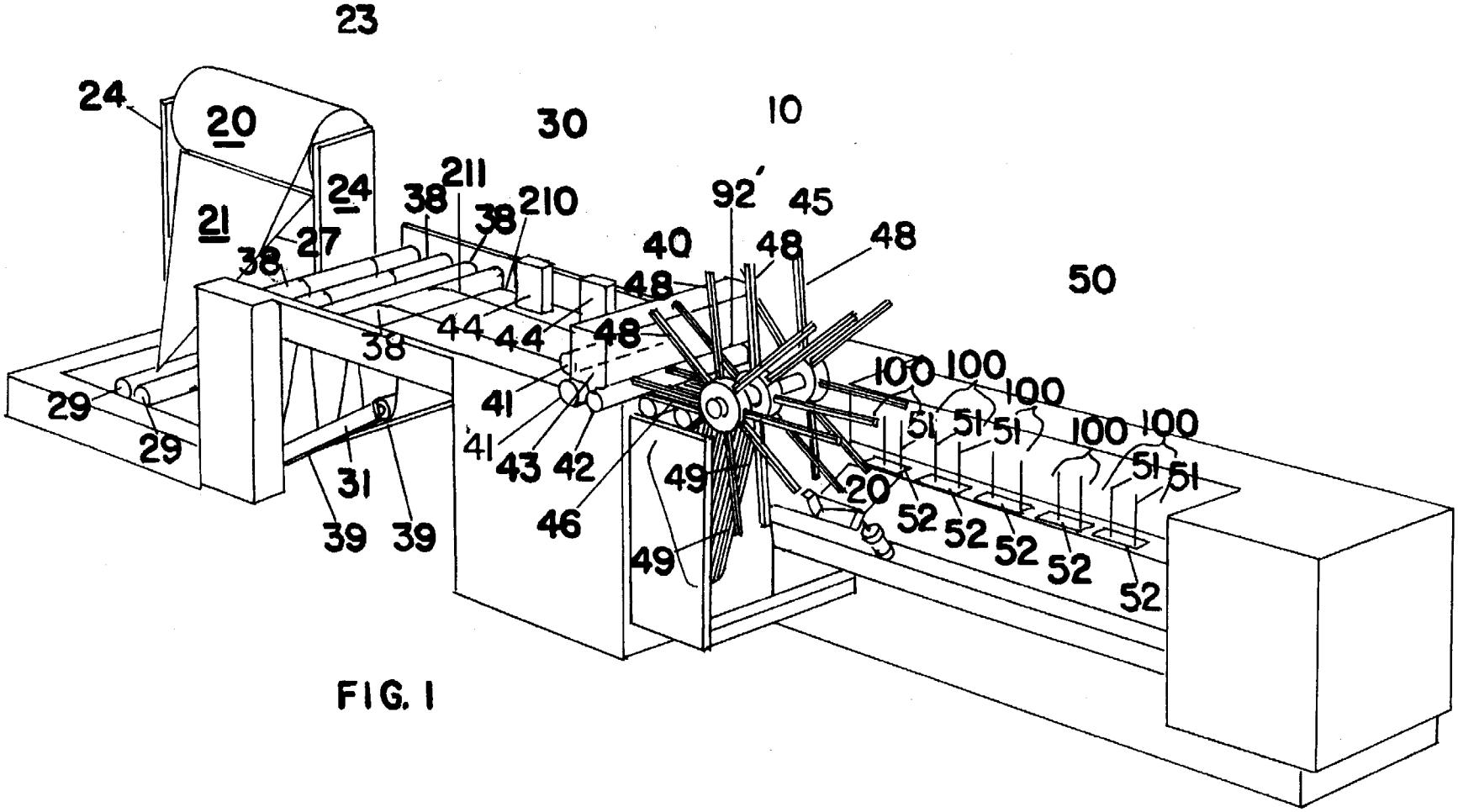
FIG. 1 shows an overall view of a sideweld bag making machine having a rotary transfer device and wicket conveyer utilizing an adjustable transfer wicket pin apparatus according to the present invention.

A typical sideweld bag making machine 10 having a rotary transfer device 45 and wicket conveyer 50 is shown in FIG. 1. The bag making machine itself is preceded by a large roll of plastic film 20 mounted on supports 24 in unwind stand 23. Film 21 is drawn off roll 20 and over folding frame 27, through creasing rolls 29 and into bag machine 10. Film 21 is aligned with folding frame 27 in such a manner that edges 210 and 211 of film 21 are not placed directly on top of each other. Rather, there is a transverse displacement of edge 210 with respect to edge 211 so as to provide a lip 91 in finished bag 90 through which openings 93 will be placed and through which transfer wicket pins 51 will pass as the bag is stacked on wicket conveyer 50.

Bag machine 10 is of the known type, having a compensation section 30, a sealing section 40, a transfer section 45, and a wicket conveyer section 50. Film 21 is drawn into compensation section 30 by capstan rolls, not shown in FIG. 1. After the capstan rolls, film is alternately passed under and over a series of fixed rolls 38 and movable rolls 39 mounted on an elastically biased arm assembly 31, said series of fixed and movable rolls comprising a film accumulation device 37. Modem high speed bag making machines such as the machine shown as 10 in FIG. 1 may also have a single roll anti-bounce assembly after film accumulation device 37, although no such assembly is shown on the bag machine of FIG. 1. Following the accumulation device, the film passes towards draw rolls 41, through compensation section 30 wherein a series of hole punches 44 are installed. Hole punches 44 are used to form openings in film 21 through which the transfer wicket pins 51 on wicket conveyer section 50 eventually will pass. As previously described, openings are located in the transversely displaced portion of the web that will be the lip 91 of finished bag 90.

Figure 2:
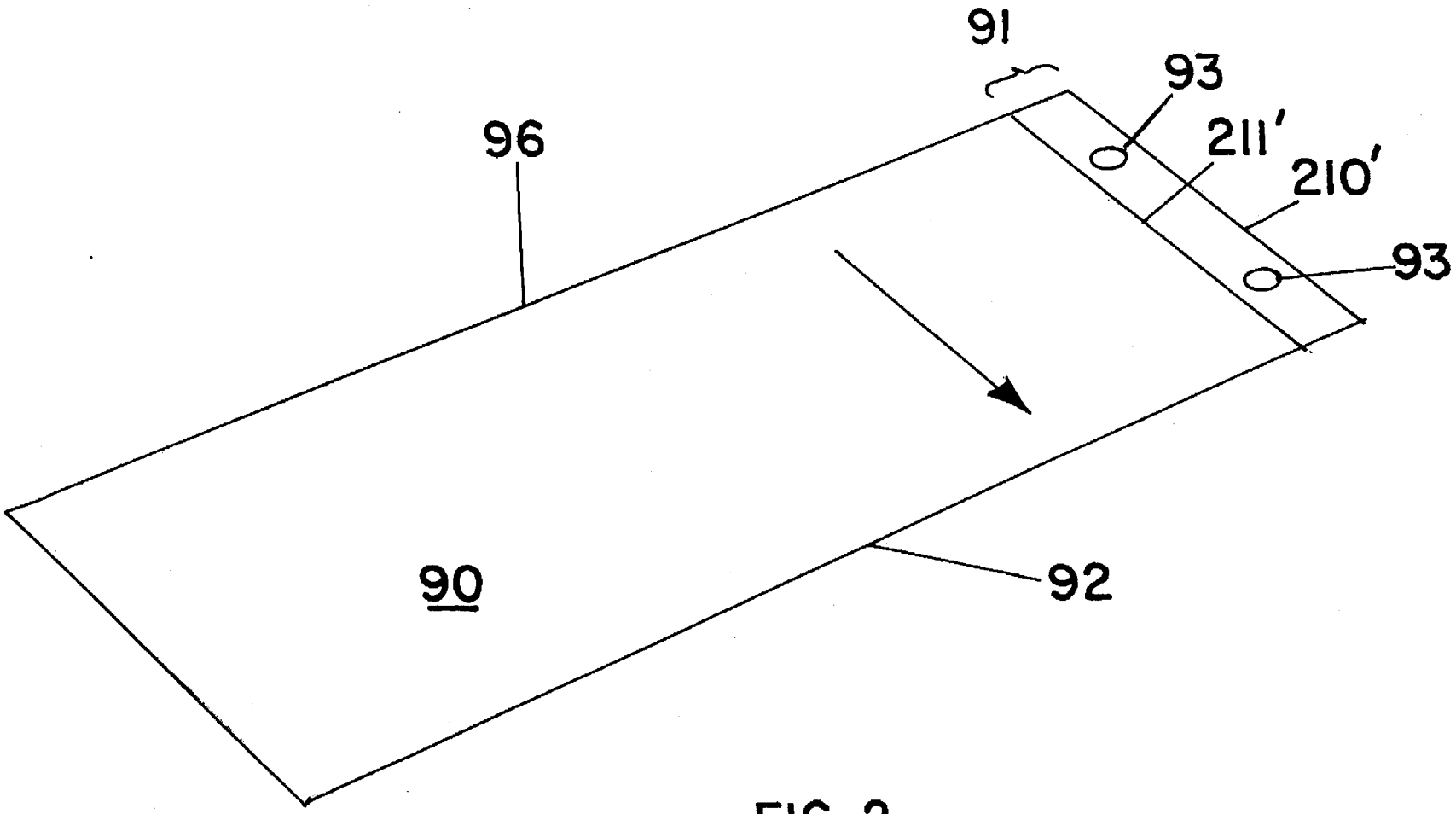
FIG. 2 shows a configuration of a wicketed sideweld bag typical of the bags stacked on the pins of the present invention.

For reference purposes, FIG. 2 shows a bag of the type that would preferably be used in conjunction with the present invention, i.e. a generic wicketed bag. Bag 90 is a lip type bag having openings 93 in the lip 91 of bag 90. Lip 91 is formed between the displaced edges 210 and 211 of folded film 21. The displaced edges in finished bag 90 as shown in FIG. 2 are identified as 210' and 211'. Also shown in FIG. 2 is a reference arrow showing the direction of film advance through the bag machine. Finished bag 90 also has a leading edge seal 92 and a trailing edge seal 96.

Once again with reference to FIG. 1, sealing section 40 contains draw rolls 41, sealing roll 42, hot knife 43, and their associated drive mechanisms. Although the present invention can be used on all known bag making machines equipped with rotary transfer devices 45, it is preferably used on modem bag making machines in which draw rolls 41 are driven by a numerically controlled servo-drive, and in which the hot knife 43 is driven by a stepping motor drive system. Draw rolls 41 are used to advance a length of folded film 21 corresponding to the width of the desired finished bag. Once this length of folded film has been advanced, hot knife 43 descends upon folded film 21 which is supported on sealing roll 42. The hot knife melts through the folded film, simultaneously severing folded film 21 and forming the trailing edge seal 96 on bag 90 and forming the leading edge seal 92' on folded film 21. Seal 92' will be the leading edge seal 92 on the next bag to be produced at sealing station 40.

Upon advance of folded film 21 by draw rolls 41, the leading edge of folded web 21 containing leading edge seal 92' is advanced onto either a rope conveyer 46 as shown in FIG. 1, or onto a metal grid that serves as the pickup position of transfer section 45. A rope conveyer is schematically illustrated in FIG. 1. The locations of the individual ropes 49 in the conveyer 46, as well as the conveyer mechanical structure, are selected to provide a relatively uniform support surface for the bag, but with necessary openings or channels to permit passage of the individual arms 48 of rotary transfer device 45.

In operation, draw rolls 41 deliver the sealed end of the film onto the rope conveyer 46, the hot knife 43 descends on the folded film 21 separating the material on the conveyer from the balance of the film 21 and simultaneously sealing the trailing edge of the material on the conveyer to form a completed bag 90 and forming the leading edge seal 92 on the folded film 21 in anticipation of formation of the next bag. Shortly after the sealing and severing of the material on the seal roll 42, a series of parallel and aligned transfer arms 48 on rotary transfer device 45 will pass through the open channels in rope conveyer 46 and contact the bag 90 from beneath. The surfaces of the transfer arms 48 that contact the bag 90 have a series of ports not shown in FIG. 1 that are connected through the structure of the rotary transfer device 45 to a source of vacuum. This vacuum, when applied to the bag through the ports in the transfer arms 48, hold the bag securely in place on the rotary transfer arms 48. Rotary transfer device 45 as shown in FIG. 1 has eight sets of transfer arms 48. In practice, while eight sets of transfer arms 48 are frequently used, other numbers of arms can also be used. Also, while three transfer arms 48 as shown in FIG. 1 comprise each set as is customary for long bags, rotary transfer device 45 can have as few as two transfer arms 48 per set, or any number greater than three as required by the particular bag geometry.

Transfer arms 48 pick up a bag 90 at rope conveyer 46 as previously described, and carry it to a stacking station equipped with one or more largely vertical sets of transfer wicket pins 51 mounted on a stacking plate 52 attached to indexing conveyer chain, not shown in FIG. 1. The transfer wicket pins 51 mounted on stacking plate 52, including the means for mounting are generally identified as 100 in FIG. 1, and constitute the subject matter of the current invention. As the transfer arms 48 carrying the bag away from rope conveyer 46 continue to rotate, they will eventually deposit the bag 90 onto transfer wicket pins 51, with the pins 51 passing through the previously punched openings 93 along the bag lip 91. As the bags are passing over transfer wicket pins 51, transfer arms 48 carrying the bag 90 are disconnected from the source of vacuum. This lack of vacuum releases the bag from the arm, and the bag drops to stacking plate 52 at the base of transfer wicket pins 51.

Referring again to FIG. 1, wicket conveyer section 50 is of the customary configuration, having a single indexing conveyer chain with the individual stacking plates 52 mounted thereon. Each stacking plate 52 will in turn have one or more upstanding transfer wicket pins 51 mounted thereon over which bags 90 will be deposited as they are stacked. Configuration of stacking plate 52, transfer wicket pins 51, and the means for mounting and adjusting the pins on the stacking plate are described in detail below. Conveyer section 50 is located within the path of arms 48 on rotary transfer device 45, but nearer the arm that carries the top of the bag, i.e. having lip 90 with openings 93. As the transfer device 45 continues to rotate, punched openings 93 in bag 90 will pass over the upstanding transfer wicket pins 51 and with continued rotation will slide down the pins 51 and be stripped from the rotary transfer device, with the bag being deposited on the surface of stacking plate 52 and bag support 71. To aid in stripping the bag from rotary transfer device 45, it is customary to disconnect transfer arms 48 from the source of vacuum as the bag 90 begins to slide over the transfer wicket pins 51, as previously described.

Figure 3:
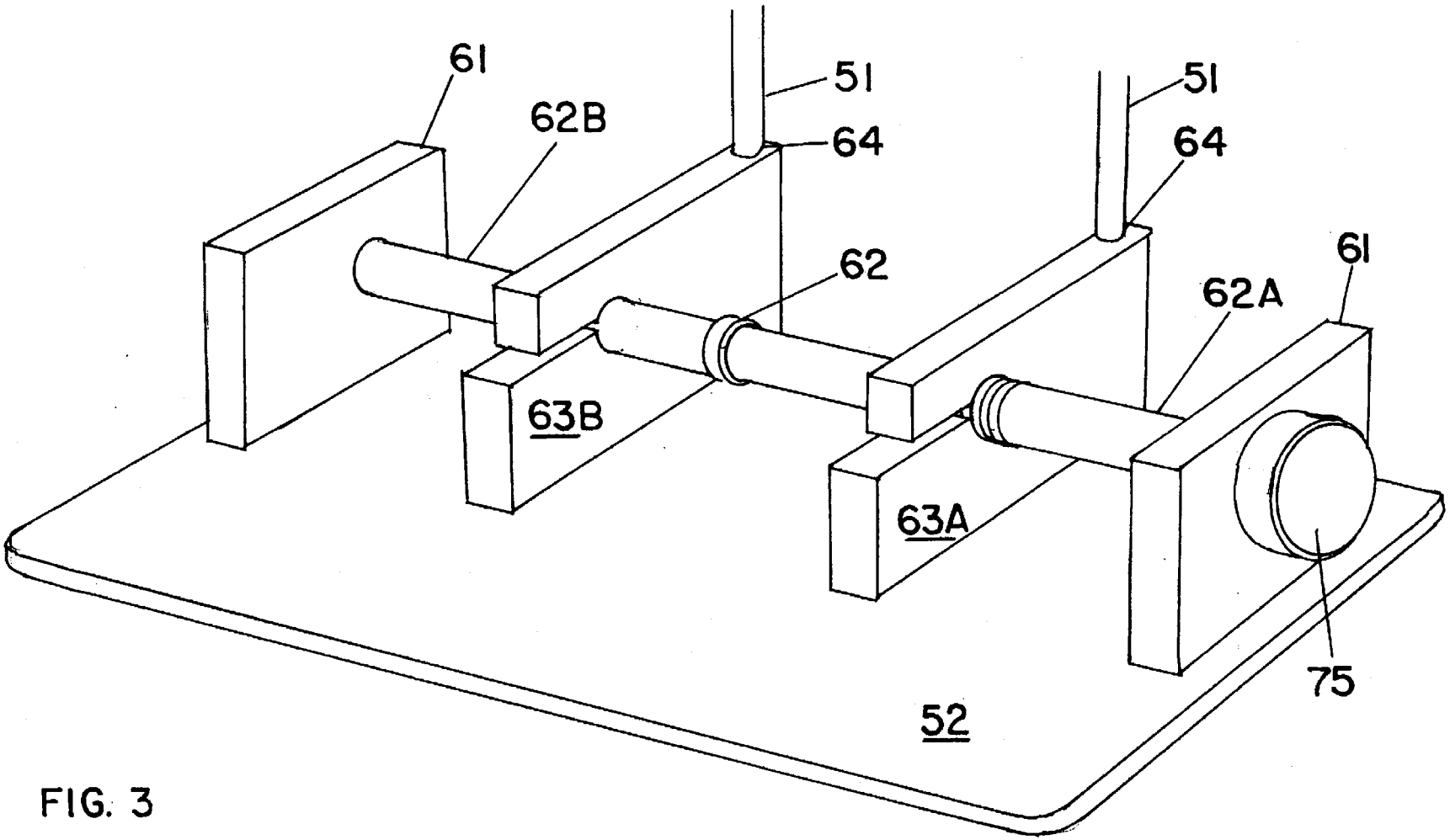
FIG. 3 shows the preferred embodiment of the adjustable transfer wicket pin apparatus of the present invention.
Figure 4:
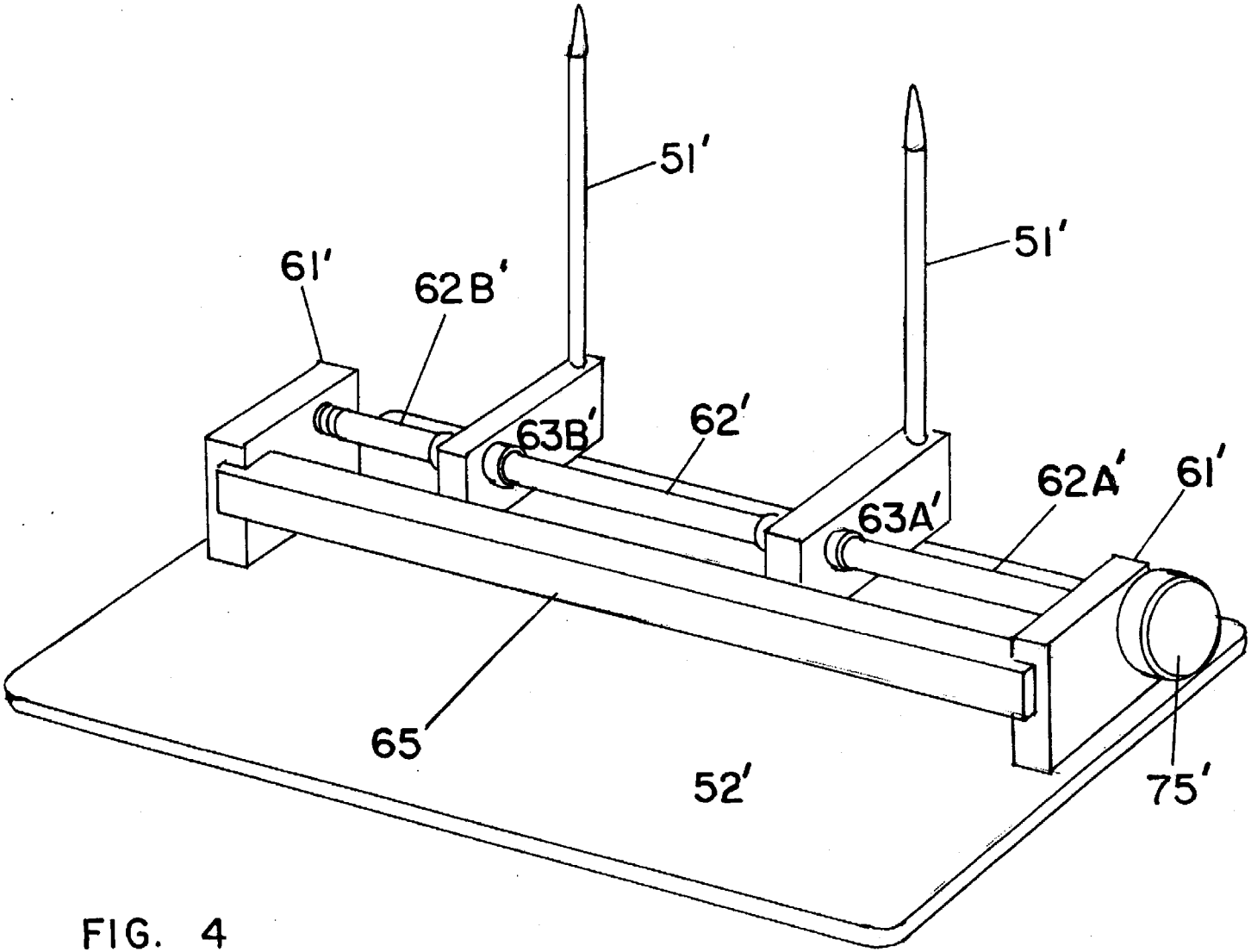
FIG. 4 shows an alternate embodiment of this present invention.

Adjustment of the transfer wicket pins 51, both as to the spacing between pins 51 and as to their angle with respect to the vertical, has, in practice proved to be difficult. Spacing between transfer wicket pins 51 is obviously necessary to ensure stacking on the pins, while the orientation of the pins with respect to the vertical influences the reliability of stripping bags from the transfer arms and consequently the uniformity of the completed bag stack. As shown in FIG. 3 and FIG. 4, the bag stacking station 100 of the present invention provides for both the axial separation of the transfer wicket 51 and their angle with respect to the vertical.

As shown in FIG. 3, there is a wicket stacking plate 52, that carries mounting blocks 61 for the transfer wicket pin support and adjustment mechanism. Wicket stacking plate 52 has mounted on its underside a conventional attachment mechanism, that connects wicket stacking plate 52 to wicket conveyer chain. The attachment mechanism plays no part in the current invention and is not shown in the Figure. Running between mounting blocks 61 is rod 62, which has a first threaded portion **62*a* and a second threaded portion 62*b*. Threaded portion 62*a* and 62*b* are of opposite hand. For instance, if section 62*a* carries a left hand thread, then section 62*b* must carry a right hand thread. Mounted on rod 62 are wicket pin bases 63*a* and 63*b*. Both bases have a similar construction, the only difference between the two being the hand of threaded aperture and boss 64. If, for instance, section 62*a* carries a left hand thread, than base 63*a* which is mounted on section 62*a* must also carry a left hand thread. Base 63*b*, which is mounted on section 62*b*, will carry a right thread as will section 62*b*. Transfer wicket pins 51 are mounted in bases 63*a* and 63*b*, in essentially vertical bores 67. As described more fully below, means are also provided for fixing the largely vertical orientation of transfer wicket pin 51**.

FIG. 4 shows an alternate embodiment of the present invention. There is a wicket stacking plate 52', that carries mounting blocks 61' for the transfer wicket pin support and adjustment mechanism. Wicket stacking plate 52' has mounted on its underside a conventional attachment mechanism, that connects wicket stacking plate 52 to wicket conveyer chain. The attachment mechanism plays no part in the current invention and is not shown in the figure. Running between mounting blocks 61' is rod 62', which has a first threaded portion **62*a'* and a second threaded portion 62*b'*. Threaded portion 62*a'* and 62*b'* are of opposite hand. For instance, if section 62*a'* carries a left hand thread, then section 62*b'* must carry a right hand thread. Mounted on rod 62' are wicket pin bases 63*a'* and 63*b'*. Both bases have a similar construction, the only difference between the two being the hand of threaded aperture and boss 64. If, for instance, section 62*a'* carries a left hand thread, than base 63*a'* which is mounted on section 62*a'* must also carry a left hand thread. Base 63*b'*, which is mounted on section 62*b'*, will carry a right thread as will section 62*b'*. Transfer wicket pins 51' are mounted in bases 63*a'* and 63*b'*, in essentially vertical bores 67'. As described more fully below, there is also an angle section 65 that contacts mounting blocks 61 and the upper surface of an adjustment lug on wicket pin base 63. Adjustment lug is not visible in FIG. 4 as it is covered by angle section 65**.

FIG. 5, however, shows the main features of wicket pin base 63 and 63' and the adjustments for the vertical orientation of transfer wicket pin 51. As previously indicated, transfer wicket pin bases 63 and 63' have threaded apertures and bosses 64 and 64' through which rod 62 will pass. There is also an essentially vertical aperture 67 and 67' through which transfer wicket pin 51 will pass. Not shown in the figures is a means to secure transfer wicket pin 51 in aperture 67 and 67'. In practice, transfer wicket pin 51 will be secured in aperture 67 and 67' by means of a set screw or other similar device, all as known to those skilled in the mechanical arts.

Figure 5A:
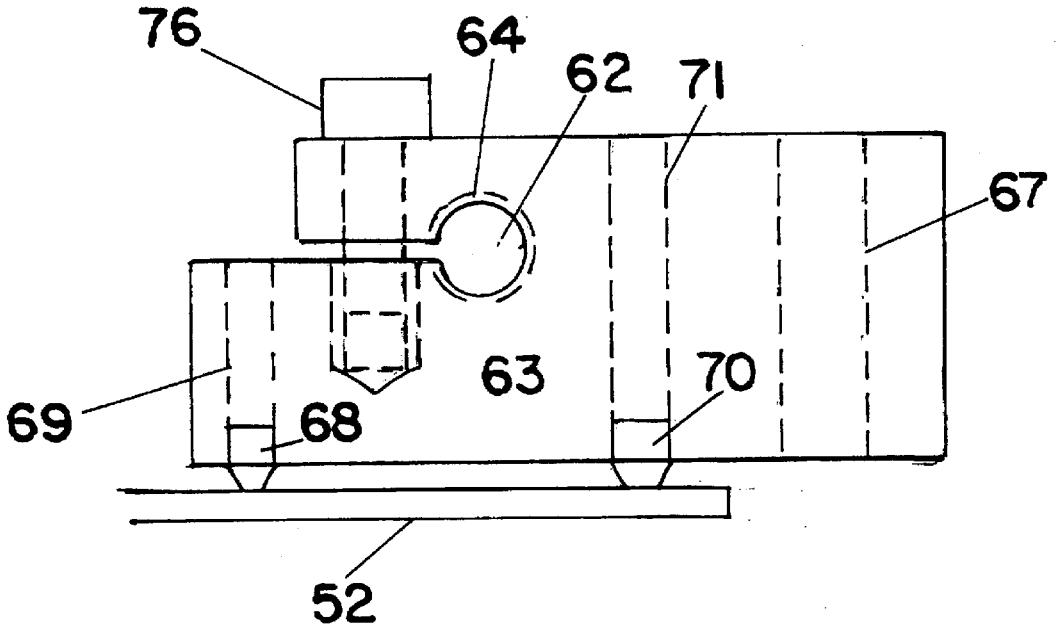
FIG. 5*a* and 5*b* show sections through transfer wicket pin bases according to the present invention.

The orientation of transfer wicket pin 51 with respect to the vertical is preferably achieved through the combination of jacking screws 68 and 70, which pass through threads aperture 69 and 71 respectively in transfer wicket pin base 63. As shown in FIG. 5*a*, jacking screw 68 bears against stacking plate 52 on one side of threaded rod 62, while jacking screw 70 bears against plate 52 on the opposite side of threaded rod 62. As previously indicated, transfer wicket pin base 63 is mounted on rod 62 through threaded aperture and boss 64, and therefore is able to rotate about the axis of rod 62. As jacking screw 68 is advanced towards stacking plate 52, transfer wicket pin base 63 will rotate clockwise as shown in FIG. 4 until jacking screw 70 bears on plate 52. Contact between jacking screws 68 and 70 and stacking plate 52 limit the clockwise rotation of transfer wicket pin base 63.

Figure 5B:
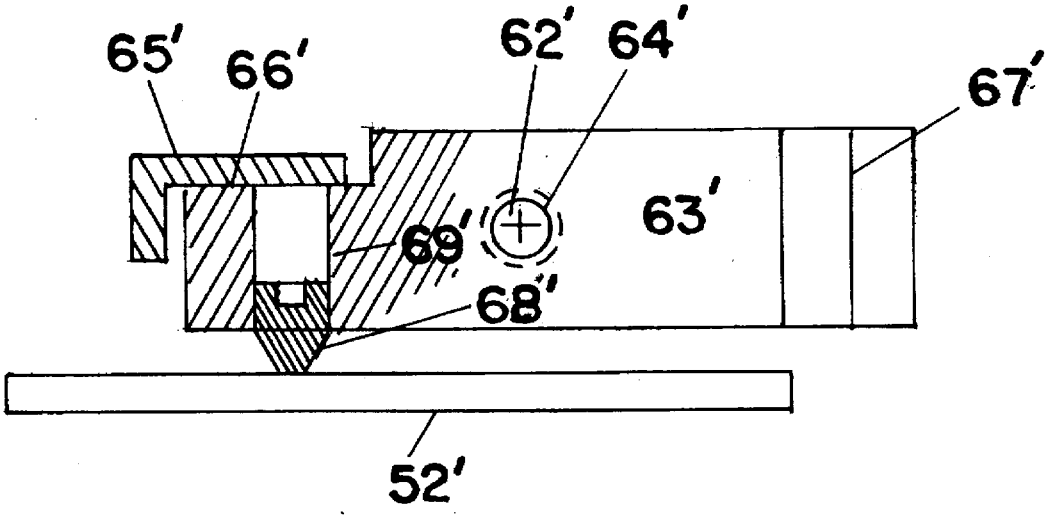
Figure 6:
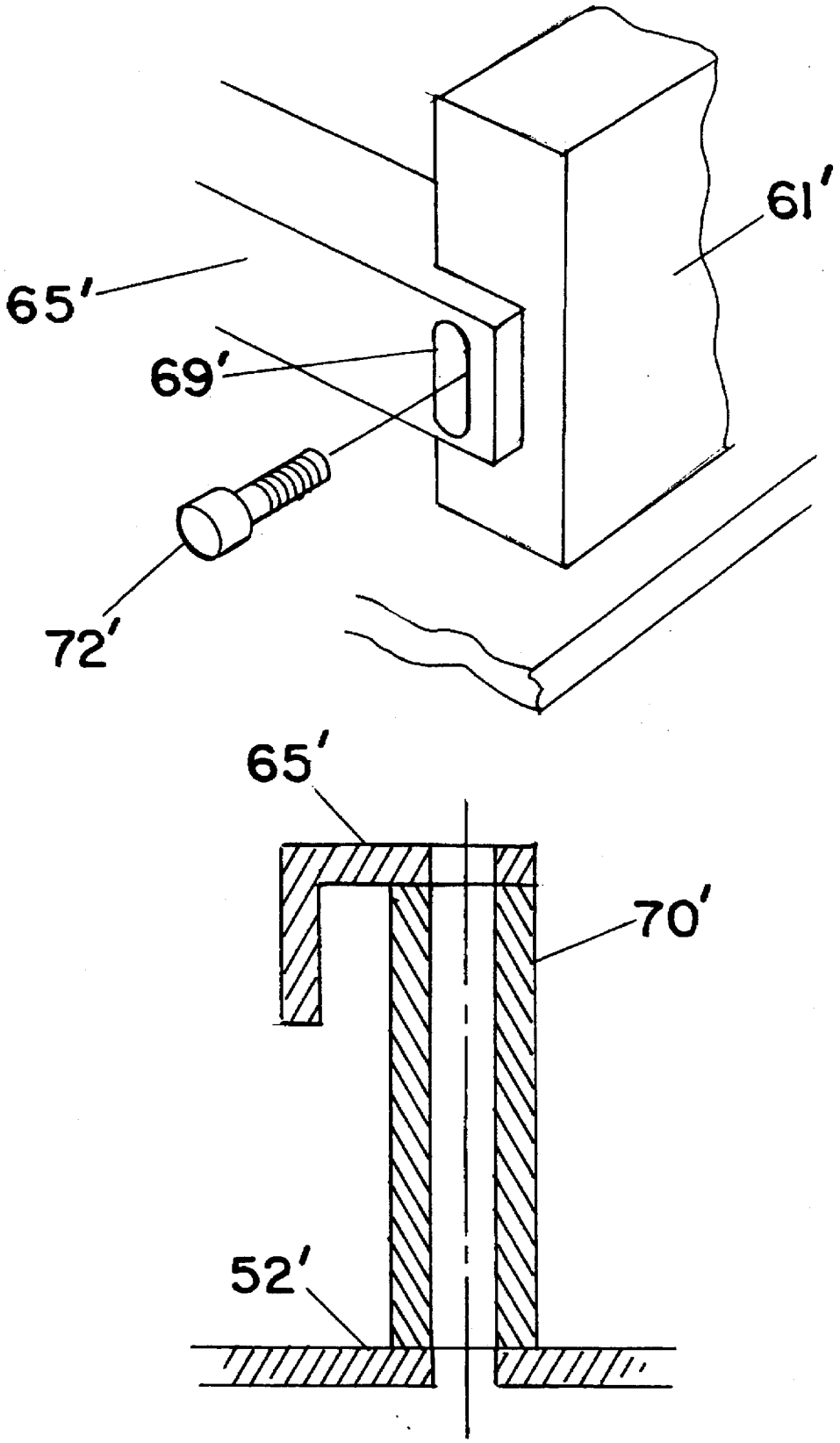
FIG. 6 shows two methods of mounting the angle section.

An alternate method for setting the orientation of transfer wicket pin 51 with respect to the vertical is also shown in FIG. 5*b*. In this embodiment, control is achieved through the combination of jacking screws 68' which passes through threads aperture 69' in transfer wicket pin base 63'. As shown in FIG. 5*b*, jacking screw 68' bears against stacking plate 52'. As previously indicated, transfer wicket pin base 63' is mounted on rod 62' through threaded aperture and boss 64', and therefore is able to rotate about the axis of rod 62'. As jacking screw 68' is advanced towards stacking plate 52', transfer wicket pin base 63' will rotate clockwise as shown in FIG. 5*b*. *The lower surface of angle section 65'* bears against the top surface of adjustment lug 66' on transfer wicket pin base 63' to limit the clockwise rotation of transfer wicket pin base 63'. Angle section 65' may be positioned for this rotation limiting function by adjustably mounting angle 65' to mounting blocks 61' with a screw 72' through angle extension 69' as shown in FIG. 6, or by mounting angle 65' to stacking plate 52' by one or more vertically placed screws and shim packs or spacers in the area of angle 65 generally identified as 70'. FIG. 6 identified these connection methods.

Operation of the adjustment device is quite simple. Assuming that the adjustable assemblies are being used for the very first time, the operator's first adjustment will be at the vertical pin angle. With transfer wicket pins 51 in the bores 67 of bases 63, the operator adjusts jacking screws 68 and 70 in each base until the desired near vertical angle of its respective transfer wicket pin 51 is attained. If the alternate embodiment is used, the operator adjusts jacking screw 68' in each base until the desired orientation is achieved. At this point the operator will secure angle 65' to contact the top surfaces of lug 66'. In practice, once the vertical angle has been set, further adjustment should be a rare occurrance.

Spacing of the tips of the transfer wicket pins 51 is then set by turning knob 75 attached to rod 62. In view of the opposite hand threads on portions 62*a* and 62*b* of rod 62, and the corresponding threads of the threaded apperature 64 of transfer wicket pin bases 63*a* and 63*b*, rotation of knob 75 and rod 62 will cause a change in the spacing the wicket pin bases 63 and transfer wicket pins 51. Rotation of knob 75 and rod 62 is continued until the desired separation is achieved. For the preferred embodiment, this spacing is then locked by tightening screws 76 in base 63. The ease of pin spacing adjustment will result in significant time savings when compared with traditional methods of transfer wicket pin adjustment. Once pin spacing has been set on all wicket plates, operation of the bag machine 10 can resume in the usual manner.

Manufacture and delivery of the bags onto transfer wicket pins 51 will continue until a preselected number of bags corresponding to the desired number of bags in each stack has been produced at the sealing section 40. At that time, the sealing section 40 of the bag machine 10 will pass through one or more idle cycles, i.e. no material is delivered by draw rolls 41 to hot knife 43 and seal roll 42, to enable the wicket conveyer chain 53 to ultimately index the fully formed stack of bags from the stacking station 54 and present a new set of transfer wicket pins 51 on stacking plate 52 for collecting the next set of bags at stacking station 54 without interference from newly formed bags. Since rotary transfer device 45 has one or more bags in transit from sealing section 40 to stacking station 54 at any given time, indexing of wicket conveyer chain 53 is delayed until such time as the last of the counted bags is delivered to transfer wicket pins 51.

Usually bag production will be resumed in anticipation of a new set of transfer wicket pins 51 being properly located at the stacking station by the time the rotary transfer device 45 brings the first of the new bag stack to the stacking location. The number of idle cycles at the sealing station is determined by the time needed for the wicket conveyer index cycle. Bag production at the sealing station will continue until the preselected number of bags per stack has been produced, at which point the overall cycle of idle cycles, time delay, wicket conveyer index cycle, and resumption of bag production will repeat.

While the present invention has been described in relation to its preferred embodiment, it will be apparent to those skilled in the art that other embodiments may be developed without departing from the scope of the claimed invention.

I claim:

1. A transfer wicket pin adjustment and mounting assembly for use on wicket conveyors comprising:

a) a wicket base plate, b) a threaded rod having a first threaded portion and a second threaded portion, said first threaded portion and said second threaded portion having threads of opposite hand, c) Mounting blocks rotatably mounting both ends of said threaded rod to said wicket base plate, d) A first transfer wicket pin base mounted on said first threaded portion, e) A second transfer wicket pin base mounted on said second threaded portion, f) Both said first transfer wicket pin base and said second transfer wicket pin base having a largely vertical screw adjustment extending from said transfer wicket pin base to said wicket base plate for rotating said transfer wicket pin base about said threaded rod.

2. The transfer wicket pin adjusting and mounting assembly for use on wicket conveyors according to claim 1 further comprising a knob mounted to one end of said threaded rod, whereby rotation of said knob will rotate said rod and alter the spacing between said transfer wicket pin bases.

3. A transfer wicket pin adjusting and mounting assembly according to claim 2 further comprising a second screw adjustment extending from said base to said wicket base plate, said second screw adjustment extending from said wicket pin base on the opposite side of said threaded rod than said first screw adjustment.

4. A transfer wicket pin adjustment and mounting assembly for use on wicket conveyors according to claim 3 further comprising a first transfer wicket pin mounted on said first wicket pin base and a second transfer wicket pin mounted on said second wicket pin base.

5. A transfer wicket pin adjusting and mounting assembly according to claim 2 further comprising and angled section adapted to engage an upper surface of said first transfer wicket pin base and said second transfer wicket pin base near said screw adjustment.

6. A transfer wicket pin adjustment and mounting assembly for use on wicket conveyors according to claim 5 further comprising a first transfer wicket pin mounted on said first wicket pin base and a second transfer wicket pin mounted on said second wicket pin base.

7. In a bag making machine having a heated sealing and severing station, a rotary transfer mechanism, and a wicketing conveyor having wicket base plates carrying upstanding transfer wicket pins, the improvement comprising:

a) a wicket base plate, b) a threaded rod having a first threaded portion and a second threaded portion, said first threaded portion and said second threaded portion having threads of opposite hand, c) Mounting blocks rotatably mounting both ends of said threaded rod to said wicket base plate, d) A first transfer wicket pin base mounted on said first threaded portion, e) A second transfer wicket pin base mounted on said second threaded portion, f) Both said first transfer wicket pin base and said second transfer wicket pin base having a largely vertical screw adjustment extending from said transfer wicket pin base to said wicket base plate for rotating said transfer wicket pin base about said threaded rod.

8. The improvement according to claim 7 further comprising a knob mounted to one end of said threaded rod, whereby rotation of said knob will rotate said rod and alter the spacing between said transfer wicket pin bases.

9. A transfer wicket pin adjusting and mounting assembly according to claim 8 further comprising a second screw adjustment extending from said base to said wicket base plate, said second screw adjustment extending from said wicket pin base on the opposite side of said threaded rod than said first screw adjustment.

10. The improvement according to claim 9 further comprising a first transfer wicket pin mounted on said first wicket pin base and a second transfer wicket pin mounted on said second wicket pin base.

11. A transfer wicket pin adjusting and mounting assembly according to claim 8 further comprising an angle section adapted to engage an upper surface of said transfer wicket pin base near said screw adjustment.

12. The improvement according to claim 11 further comprising a first transfer wicket pin mounted on said first transfer wicket pin base and a second transfer wicket pin mounted on said second transfer wicket pin base.

* * * * *